US008772709B2

(12) United States Patent
Moeller et al.

(10) Patent No.: US 8,772,709 B2
(45) Date of Patent: Jul. 8, 2014

(54) ASSEMBLY FOR AN ELECTROSPRAY ION SOURCE

(75) Inventors: Roy P Moeller, San Leandro, CA (US); Rohan Thakur, Mountain View, CA (US); Felician Muntean, Danville, CA (US); Maurizio A Splendore, Walnut Creek, CA (US); Stephen Zanon, Campbell, CA (US)

(73) Assignee: Bruker Daltonics, Inc., Billerica, MA (US)

( * ) Notice: Subject to any disclaimer, the term of this patent is extended or adjusted under 35 U.S.C. 154(b) by 0 days.

(21) Appl. No.: 13/550,061

(22) Filed: Jul. 16, 2012

(65) Prior Publication Data

US 2014/0014747 A1 Jan. 16, 2014

(51) Int. Cl.

| | |
|---|---|
| ***H01J 49/26*** | (2006.01) |
| ***H01J 49/10*** | (2006.01) |
| ***H01J 49/16*** | (2006.01) |

(52) U.S. Cl.

CPC ..... *H01J 49/10* (2013.01); *H01J 49/165* (2013.01); *H01J 49/167* (2013.01)

USPC ..... 250/288; 250/281; 250/282

(58) Field of Classification Search

CPC . H01J 49/0404; H01J 49/167; H01J 49/0445; H01J 4/165; H01J 49/10

USPC ..... 250/281, 282, 288

See application file for complete search history.

(56) References Cited

U.S. PATENT DOCUMENTS

| | | | | |
|---|---|---|---|---|
| 5,349,186 | A | 9/1994 | Ikonomou | |
| 7,199,364 | B2 | 4/2007 | Thakur | |
| 2009/0250608 | A1 * | 10/2009 | Mordehai et al. | 250/288 |
| 2009/0266924 | A1 * | 10/2009 | Pui et al. | 239/696 |
| 2010/0224695 | A1 | 9/2010 | Wu | |

OTHER PUBLICATIONS

Wittmer, D. P., Chen, Y. H., Luckenbill, B. K. and Hill, H. H., "Electrospray Ionization Ion Mobility Spectrometry", Analytical Chemistry, v. 66, pp. 2348-2355 (1994).

Chen, Y. H., Hill, H. H. and Wittmer, D. P., "Thermal Effects on Electrospray Ionization Ion Mobility Spectrometry", International Journal of Mass Spectrometry and Ion Processes, v. 154, pp. 1-13 (1996).

* cited by examiner

*Primary Examiner* — Nicole Ippolito

(74) *Attorney, Agent, or Firm* — Robic, LLP

(57) ABSTRACT

An assembly for use in an electrospray ion source includes a capillary for guiding a flow of liquid generally containing analyte(s) of interest, which is to be electrosprayed into an ionization chamber, a first tube at least partially encasing the capillary such that a first conduit for guiding a first heatable gas is created proximate the capillary and a hollow member that has an internal evacuated space and is located at the outer circumference of the capillary such that heat transfer from the first heatable gas flowing proximate the capillary to the liquid in the capillary is impeded. The assembly provides a simple and lean/compact way of preventing excessive heat transfer to the liquid in the capillary of an electrospray ion source.

20 Claims, 5 Drawing Sheets

*FIG. 1* *(Prior Art)*

ASSEMBLY FOR AN ELECTROSPRAY ION SOURCE

BACKGROUND

The invention relates to assemblies for electrospray ion sources. Electrospray ionization (ESI) is a technique used in mass spectrometry to produce ions. It is especially advantageous for ionizing macromolecules due to its soft character without inducing too much fragmentation during ionization. The development of ESI for the analysis of biological macromolecules was rewarded with the Nobel Prize in Chemistry to John Bennett Fenn in 2002.

A liquid containing analyte(s) of interest is typically dispersed by electrospray into a fine aerosol from the tip of a capillary. Because ion formation involves extensive solvent evaporation, typical solvents for electrospray ionization are prepared by mixing water with volatile organic compounds, such as methanol or acetonitrile. To decrease the initial droplet size, compounds that increase conductivity, such as acetic acid can be added to the solution.

Large-flow electrosprays can further benefit from additional nebulization by an inert gas, such as nitrogen, which may emerge from an annular conduit opening proximate a tip of the capillary. The inert gas may also be heated in order to further promote evaporation of the spray mist. The solvent evaporates from a charged droplet until it becomes unstable upon reaching its Rayleigh limit. At this point, the droplet deforms and emits charged jets in a process known as Coulomb fission. During the fission, the droplet loses a small percentage of its mass along with a relatively large percentage of its charge. The aerosol, which as the case may be, encompasses gas-phase molecules, ions and tiny charged droplets, is sampled into the first vacuum stage of a mass spectrometer through an orifice (and/or subsequent transfer capillary) which can also be heated in order to finalize solvent evaporation from the remaining charged droplets and prevent any memory effects due to sample deposition on surfaces.

The ions observed by mass spectrometry may be quasi-molecular ions created by the addition of a proton and denoted $[M+H]^+$, or of another cation such as sodium ion, $[M+Na]^+$, or the removal of a proton, $[M-H]^-$. Multiply charged ions such as $[M+nH]^{n+}$ are often observed, which makes ESI particularly favorable for ionizing large macromolecules that would otherwise lie beyond usual detection ranges. For such macromolecules there can be many charge states, resulting in a characteristic charge state envelope.

Electrospray ionization has found favorable utility particularly for liquid chromatography-mass spectrometry (LC-MS, or alternatively high performance liquid chromatography-mass spectrometry HPLC-MS) which combines the physical separation capabilities of liquid chromatography (or HPLC) with the mass analysis capabilities of mass spectrometry. Generally, its application is oriented towards the detection and potential identification of chemicals in the presence of other chemicals, often in complex mixtures. Applications of LC-MS cover fields such as pharmacokinetics, proteomics/metabolomics, and drug development to name but a few.

As mentioned before, it has been known to use heated gas in order to promote evaporation of the droplets in the spray mist and thereby expedite the ionization process. The heated gas injected into and circulating in the ionization chamber may contact the liquid guiding capillary and transfer heat thereto. The temperature of the liquid in the capillary, however, should not exceed the boiling point since otherwise pressurized vapor within the liquid, upon emerging from the tip of the capillary, would disrupt the formation of small charged liquid droplets thereby deteriorating the ionization process and reducing ion yield. Certain analytes of interest such as proteins also respond with conformational changes to heat exposure (others even with degradation) which may be undesirable when the mass spectrometric analysis is coupled with an ion mobility analysis, for instance.

Therefore, attempts have been made to prevent excessive heat transfer to the liquid in the capillary. One way of dealing with this problem consisted in disposing a solid insulating sleeve or jacket made of fused silica about the capillary needle in order to maintain a certain temperature differential (U.S. Pat. No. 5,349,186 A to Ikonomou et al.). A similar approach in a slightly altered design was suggested by Thakur (U.S. Pat. No. 7,199,364 B2). But implementations according to such solutions result in a rather bulky design which counteracts an operator's general goal to minimize a spatial requirement for a capillary and conduit assembly.

Wittmer et al. (Anal. Chem. 1994, 66, 2348-2355) and Chen et al. (Int. J. Mass Spectrom. Ion Processes 1996, 154, 1-13) encountered problems with heat induced boiling of solvent in the capillary needle in an electrospray ion source with subsequent ion mobility drift cell which contained a heated drift gas. They suggested providing an active cooling mechanism having an outer conduit flushed with water as cooling medium which contacts a gas-filled conduit disposed about the capillary. A similar approach of active cooling was suggested by Mordehai et al. (US 2009/0250608 A1). Wu et al. (US 2010/0224695 A1), on the other hand, employ a heat exchanger which is in direct contact with the electrosprayer to control the temperature of the electrosprayer in another way of active cooling. However, the instrumental and procedural effort for maintaining active cooling, such as establishing circulation of cooling fluid, is significant.

In summary, a major problem with nebulizing ion sources utilizing a concentric nebulizer gas and a further concentric heated desolvation gas is the inadvertent heating of the central capillary. Unless the interaction length is short, the heat flux from the high temperature desolvation gas will raise the temperature of the nebulizer gas which in turn results in heating of the central capillary. Such heating may result in degradation of the sample or boiling of the solvent. Adding insulating material between the desolvation gas and nebulizer gas conduits, such as suggested by Thakur, can be effective but presents problems of finding a material with very stringent properties. It must have very low conductivity, be dimensionally stable, resist high temperatures and not outgas or shed particulates. Most materials fulfilling these requirements are bulky and their use would significantly increase the diameter of an electrospray assembly.

Hence, there is still a need for a simple and lean/compact way of preventing excessive heat transfer to the liquid in the capillary of an electrospray ion source.

SUMMARY

In a first aspect the invention pertains to an assembly for an electrospray ion source. A capillary is provided for guiding a flow of liquid generally containing analyte(s) of interest, which is to be electrosprayed into an ionization chamber. A first tube is provided that at least partially encases the capillary such that a first conduit for guiding a first heatable gas is created proximate the capillary. A hollow member having an internal evacuated space is located at an outer circumference of the capillary such that heat transfer from the first heatable gas flowing proximate the capillary to the liquid in the capillary is impeded.

Providing for an evacuated space between the gas guiding conduit(s) and the capillary effectively prevents excessive heating of the liquid in the capillary. It offers very low conductivity, guarantees dimensional stability, provides high temperature resistance and does not entail outgassing or shedding of particulates. It also allows for a lean and compact design of the assembly.

The term "evacuated" in the context of the present disclosure may generally mean any pressure substantially below ambient and/or atmospheric pressure. Basically, pressures of less than 100 mbar are suitable, however, with pressures lower than one millibar being particularly preferred. Furthermore, the walls of the hollow member may comprise a material with high thermal resistance, such as characteristic for certain types of glasses, ceramics, or plastics.

In various embodiments, the hollow member is an at least partially hollow jacket or hollow sleeve disposed around the capillary, and the evacuated space is formed within the at least partially hollow jacket or hollow sleeve. Alternatively, the hollow member is a double-layered wall of the capillary itself, and the evacuated space is formed within the double-layered wall. Embodiments of an evacuated sleeve or jacket, such as a metal vacuum insulated tube interposed between the capillary and the first conduit for instance, offer very low thermal conductivity and generally feature low wall thickness. Constructed of two concentric thin wall tubes with an at least partially evacuated space between them, for example, it can function over a wide temperature range while being very inert and robust.

Optionally, a tubular structure containing a stagnant gas may be used. The tubular structure can be interposed between the hollow member and the outer circumference of the capillary to further increase thermal resistance. In favorable embodiments, a heat conductor is additionally provided, the heat conductor reaching or extending into an inner space of the tubular structure in order to contact, or be immersed within, the stagnant gas and receive heat therefrom, and further reaching or extending upstream into a region where a substantially unheated first gas is supplied to the first conduit so that the substantially unheated first gas may contact a portion of the heat conductor directly or indirectly thereby receiving and carrying away heat which originates from the stagnant gas. To further increase the heat exchange effect, the substantially unheated first gas can even be cooled prior to introduction into the first conduit. In some embodiments, the heat from the conductor could either alternatively or additionally be dissipated to ambient air or an external structure to generally accelerate heat transmission.

In various embodiments, the evacuated space is bordered by side walls of the hollow member, which either, at an inner side, carry a coating for reflecting heat radiation, or have a radiative heat shield with generally low emissivity interposed therebetween, such as a thin foil of low emissivity or an aerogel made of a 'radiatively opaque' material. This measure may further increase heat resistance.

In various embodiments, the first heatable gas in the first conduit receives heat from a heat generator, such as a resistive heater. The heat generator can be thermally coupled to the first tube at an outer circumference thereof. Alternatively, the heat generator may heat the first heatable gas at a position outside the first conduit.

In various embodiments, the assembly further comprises a second tube at least partially encasing the first tube such that a second conduit for guiding a second heatable gas, such as a desolvation gas, is created proximate the first tube. The second heatable gas in the second conduit can receive heat from a heat generator, and some heat can be transmitted through an interface between the second conduit and the first conduit from the second heated gas to the first heatable gas flowing through the first conduit. Alternatively, the first heatable gas in the first conduit and the second heatable gas in the second conduit may simultaneously receive heat from a heat generator being located at an interface between the first conduit and the second conduit, and being thermally coupled to the first conduit at an outer circumference thereof and to the second conduit at an inner circumference thereof. The interface between first and second conduit may be provided by the wall of the first tube, for instance.

In various embodiments, at least one of the first heatable gas and the second heatable gas is an inert gas, such as molecular nitrogen ($N_2$). However, also other inert gases may be suitable for this purpose.

In some embodiments, the capillary is removably disposed within one of the first tube, an evacuated sleeve, an evacuated jacket, and a tubular structure containing a stagnant gas. With such configuration the capillary can be drawn out of a receptacle structure formed by at least one of the first tube, the evacuated sleeve, the evacuated jacket, and the tubular structure for maintenance purposes, for example. It could then be cleaned and reinserted. Alternatively, it can be disposed of and replaced by a new capillary. Fixed dimensions of the capillaries employed ensure their geometric compatibility with the receptacle structure.

When a pneumatically assisted electrospray probe is held at high electric potential, the evacuated hollow member, and/or the heat conductor, can be held at ground potential, at the high probe potential or at any intermediate potential. There is, however, an advantage to having the cooler interior parts of an electrospray probe grounded in that any electrical insulator surrounding the electrospray capillary and intended for preventing arcing could be kept cool as well. Generally, a low operating temperature greatly increases the choice of materials for the electrical insulator that can be used.

In a second aspect, the invention pertains to an assembly for an electrospray ion source. A capillary is provided for guiding a flow of liquid generally containing analyte(s) of interest, which is to be electrosprayed into an ionization chamber. A first tube is provided that at least partially encases the capillary such that a first conduit for guiding a first heatable gas is created proximate the capillary. A second tube at least partially encases the first tube such that a second conduit for guiding a second heatable gas is created proximate the first tube. Further, a hollow member having an internal evacuated space is located at an interface between the first conduit and the second conduit such that heat transfer from the second heatable gas flowing proximate the first tube to the first heatable gas in the first tube is impeded.

In various embodiments, the second heatable gas in the second conduit can receive heat from a heat generator thermally coupled to the second tube at an outer circumference thereof. Alternatively, the second heatable gas in the second conduit can receive heat from a heat generator at a position outside the second conduit. The heat generator may be a resistance heater, but also heating devices based on other operating principles are conceivable.

In a third aspect, the invention pertains to an assembly for an electrospray ion source. A capillary is provided for guiding a flow of liquid generally containing analyte(s) of interest, which is to be electrosprayed into an ionization chamber. A tube at least partially encases the capillary such that a conduit for guiding a heatable gas is created proximate the capillary. Further, a thermal insulation is located at an outer circumference of the capillary such that heat transfer from the heatable gas flowing proximate the capillary to the liquid in the capillary is impeded. Also, a tubular structure containing a stagnant gas is interposed between the thermal insulation and the outer circumference of the capillary to further increase thermal resistance. A heat conductor reaches or extends into an inner space of the tubular structure in order to contact, or be immersed within, the stagnant gas and receive heat therefrom. The heat conductor reaches or extends also upstream into a region where a substantially unheated gas is supplied to the conduit so that the substantially unheated gas may contact a portion of the heat conductor directly or indirectly thereby receiving and carrying away heat which originates from the stagnant gas.

The heat conductor may be made from a material with low intrinsic heat resistance. Metals such as silver, aluminum or copper, for instance, are particularly suited for this purpose. The heat conductor mainly serves to receive heat from the stagnant gas, which despite the thermal insulation measures is transmitted over time from surrounding heated gas flows to the center of the probe structure and accumulates there (causing a gradual rise in temperature). The shape and position of the heat conductor are preferably chosen such that it acts as a heat exchanger through pre-heating the otherwise largely unheated gas upon entering the conduit. The actual heating of the heatable gas to a common operating temperature of the electrospray happens downstream from the contact region of the unheated (or merely slightly pre-heated) gas with the heat conductor.

In various embodiments, the thermal insulation may comprise an at least partially evacuated hollow sleeve or jacket disposed about the capillary. Additionally or alternatively, the thermal insulation may comprise one of a stagnant air layer, a circulating air flow or a solid layer of material with high heat resistance, such as fused silica or other types of glass or ceramics.

In some embodiments, at least portions of the heat conductor may have a structured surface to allow for high heat transmission capabilities. Such design can make the heat transfer from a position at the electrospray probe center to more outlying regions more efficient.

In a fourth aspect, the invention relates to another assembly for an electrospray ion source. A capillary is provided for guiding a flow of liquid generally containing analyte(s) of interest, which is to be electrosprayed into an ionization chamber. A tube at least partially encases the capillary such that a conduit for guiding a heatable gas is created proximate the capillary. Further, a thermal insulation is located at an outer circumference of the capillary such that heat transfer from the heatable gas flowing proximate the capillary to the liquid in the capillary is impeded. Also, a heat conductor thermally contacts at least one of the thermal insulation at a radially inward side and the capillary at a radially outward side in order to receive heat therefrom, wherein the heat conductor likewise thermally contacts a conduit portion in a region where a substantially unheated gas is supplied to the conduit so that the substantially unheated gas may receive and carry away heat which originates from the thermal insulation or the capillary.

Such a "closed loop" arrangement of heat circulation may decrease the heat load on the ambience of the electrospray probe and possibly lower the requirements on the heater device. Thus, it entails advantages compared to arrangements where heat from inner parts of the spray probe is just radiated off to the environment without re-using it. Thermal contact in this context can mean direct physical contact, however, is not restricted to such construction. Instead, intermediate elements, such as a hollow tube containing a stagnant gas layer in which a portion of the heat conductor is immersed, may be provided as will become apparent from embodiments to be described in detail further below.

BRIEF DESCRIPTION OF THE DRAWINGS

The invention can be better understood by referring to the following figures. The elements in the figures are not necessarily to scale, emphasis instead being placed upon illustrating the principles of the invention (often schematically). In the figures, like reference numerals generally designate corresponding parts throughout the different views.

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

Figure 1:
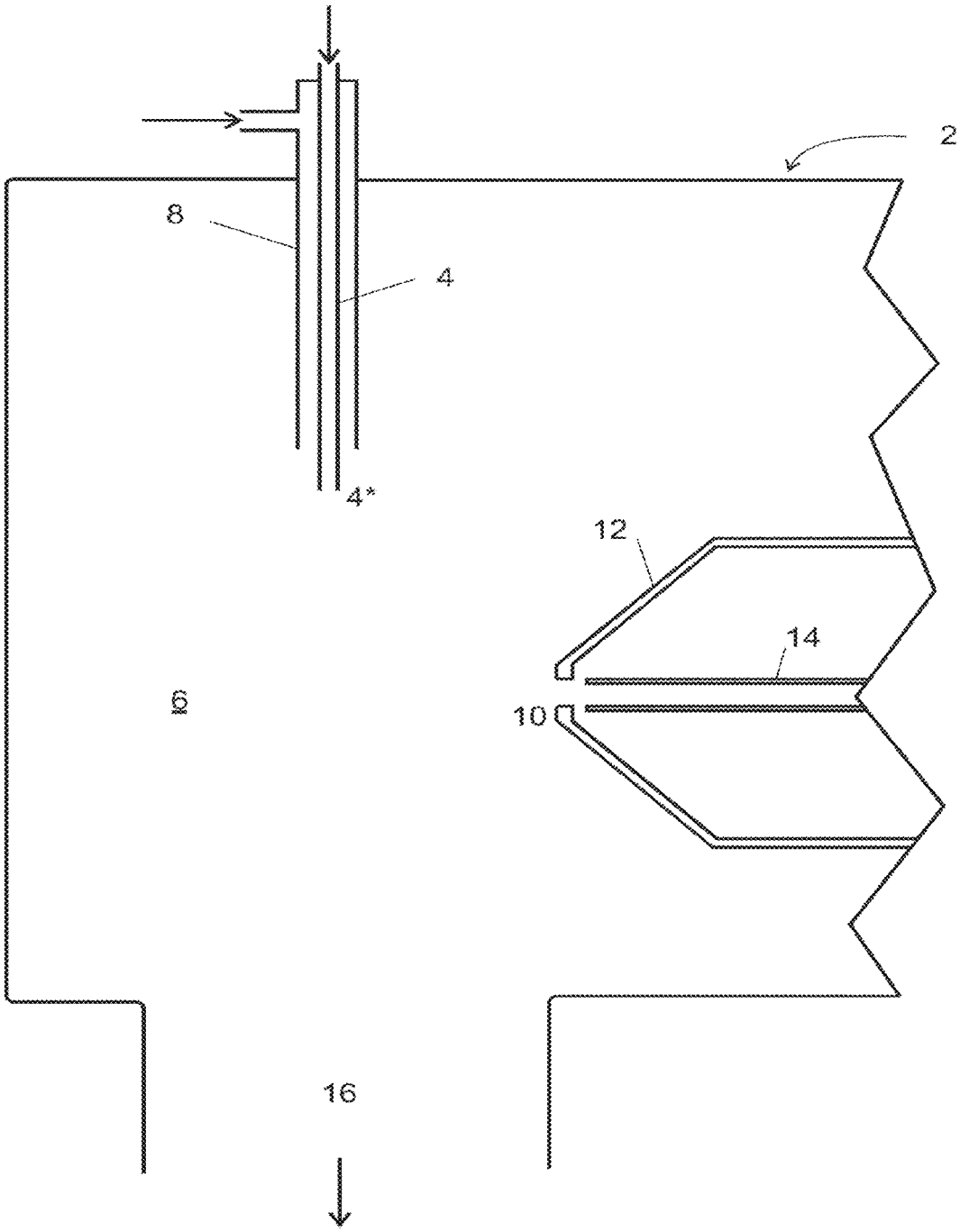
FIG. 1 is a schematic diagram of a conventional electrospray ion source configuration.

FIG. 1 is a general and schematic depiction of an electrospray ion source assembly 2 and has a central capillary 4 that is part of an ion probe reaching into an ionization chamber 6. The central capillary 4 guides and electrosprays liquid that can contain analyte(s) of interest into the chamber 6. A (annular) conduit 8 created by a tube which is disposed about the central capillary 4 feeds in a nebulizer gas which pneumatically assists in the formation of droplets at the tip 4* of the central capillary 4. Optionally, in another conduit (not shown) surrounding the nebulizer conduit 8 a heated desolvation gas can be injected into the chamber 6, the heat of which promotes droplet evaporation. The ions resulting from the electrospray ionization process in the chamber 6 are attracted in a direction of, and guided through, an orifice 10 at a shield electrode 12. The shield electrode 12 may have a conical portion and can serve as a counter-electrode to establish a voltage difference relative to the tip 4* of the capillary 4. The ions are then transmitted into a transfer capillary 14 that constitutes an interface between the atmospheric pressure of the chamber 6 and a first vacuum stage of the mass spectrometer (not shown). Residual spray mist and solvent gas in the ionization chamber 6 can be removed via exhaust port 16 which is located generally in opposing relation to the end of the central capillary 4 and may be coupled to an exhaust pump (not shown).

Figure 2:
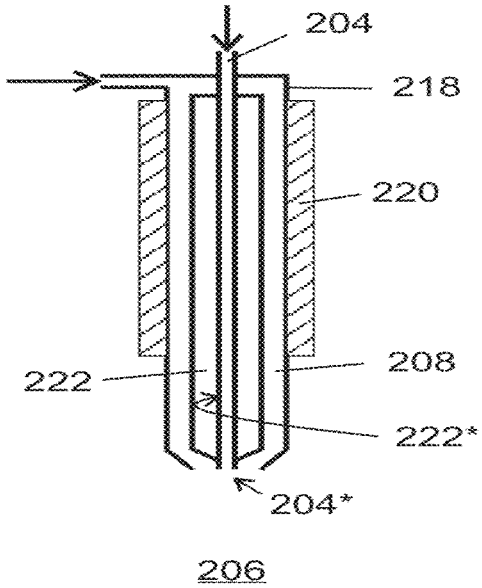
FIG. 2 is a cross-sectional diagram that illustrates a first embodiment according to principles of the invention.

FIG. 2 is a first example of an assembly for an electrospray ion source constructed according to principles of the invention. It has a central capillary 204 that receives and transports a liquid, such as an effluent of an LC column, from one end to another end reaching into an ionization region 206. A tube 218 with a (optional) tapering portion at its end is disposed at least partially around the central capillary 204 such that an (annular) conduit 208 for guiding a heatable gas, such as a nebulizer gas, is created proximate the central capillary 204. In the example shown a heater 220, such as a resistive heater, is located at an outer circumference of the conduit 208 and is in thermal contact therewith. The heatable gas can flow from a point where it is supplied to the conduit 208 to an exit region of the conduit 208 proximate the tip 204* of the capillary 204 while being heated along a section thereof.

To prevent excessive heat transfer from the heated gas to the liquid in the central capillary 204, a double-wall jacket 222 is disposed around and, in this example, directly contacting the central capillary 204. The jacket 222, or rather the space between the walls, is evacuated internally to provide a largely annular evacuated space, and, by virtue of its position at the outer circumference of the central capillary 204, impedes heat transfer from the heatable gas, when heated, flowing proximate the central capillary 204 to the liquid in the central capillary 204. Simple calculations indicate that the evacuated jacket 222 is superior to any design using insulating gas or solids when it comes to preventing heat transfer. Even with high emissivity surfaces, the heat load is lower than with conventional insulation configurations in the temperature range employed in the application of heated gas. With the inner surfaces of the jacket 222 protected by vacuum, the emissivity can be kept quite low even at high temperatures. For example, heater temperatures from slightly above ambient or lab temperature, for instance at about 70 deg C, up to about 800 deg C may be necessary to promote rapid evaporation of spray droplets. At these temperatures most metals are highly reactive and emissivity increases unless protection is provided.

In a variant, the evacuated sleeve or jacket 222 may be replaced by a double-walled central capillary (not shown) wherein a space between the two walls of the central capillary is evacuated. In this manner an integral design of a high thermal resistance layer can be provided.

The evacuated space within the jacket or sleeve 222, at an inner side 222*, may carry a coating for reflecting heat radiation. Heat radiation, in the temperature regime usually arising from the operating conditions employed, normally lies in the infrared wavelength range. Materials showing high reflectance in the infrared wavelength range and therefore being capable of reflecting heat radiation include gold, silver and aluminum, for example. The evacuated space may also be divided into two adjacent compartments by a divider wall (not illustrated), such as made from a thin foil from a suitable metal, which is interposed between the inner and outer walls of either the evacuated sleeve or the capillary and acts as a radiation heat shield with generally low emissivity.

In the embodiment of FIG. 2 the heater 220 is concentric to the conduit 208 at an outer circumference thereof, but a vacuum insulated jacket 222 can be used in designs where the heatable gas is heated prior to introduction to the conduit 208 by an external heater (not shown). In such an embodiment, the evacuated sleeve 222 would favorably reach up to the upper end of tube 218 so that capillary 204 and the gas heated before entering the conduit 208 never contact directly (apart maybe from a small portion downstream at the capillary tip 204* which however is negligible). Additional thermal insulation can also be positioned outside of the heater or outside of the gas conduit to generally reduce heat loss and thereby lower power requirements. Applicants have found that significant heat loss may frequently occur when the heater is run at high temperature.

Figure 3:
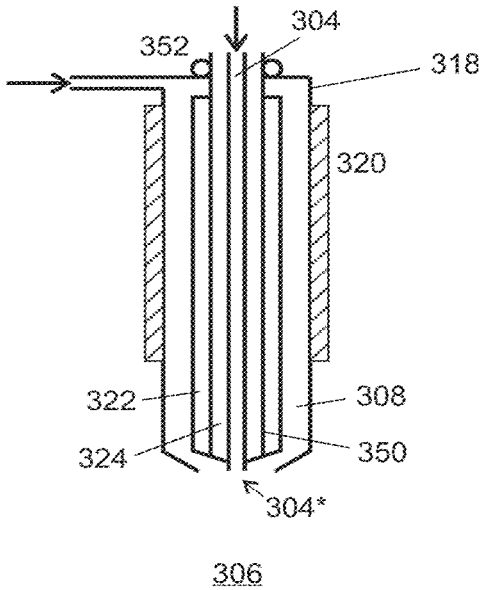
FIG. 3 is a cross-sectional diagram that illustrates a second embodiment according to principles of the invention.

FIG. 3 is a further example of an assembly for an electrospray ion source according to principles of the invention. It has a central capillary 304 that receives and transports a liquid from one end to another end reaching into an ionization region 306. A tube 318 is disposed at least around a part of the central capillary 304 such that a conduit 308 for guiding a heatable gas, such as a nebulizer gas, is created proximate the central capillary 304. In the example shown a heater 320, such as a resistive heater, is located at an outer circumference of the conduit 308 and is in thermal contact therewith. The heatable gas can flow from a point where it is supplied to the conduit 308 to an exit region of the conduit 308 proximate the tip 304* of the capillary 304 while being heated.

A double-wall jacket 322 is disposed around the central capillary 304. The jacket 322 is evacuated internally as previously described and, by virtue of its position around the central capillary 304, impedes heat transfer from the heatable gas, when heated, flowing proximate the central capillary 304 to the liquid in the central capillary 304. In the example shown, a further hollow tube 350 is disposed between the jacket 322 and the central capillary 304 and around the capillary 304. The hollow tube 350 together with the outer circumference of the capillary 304 confines a hollow space filled with a stagnant gas layer or stagnant air layer 324 as additional heat resistive layer.

The hollow tube 350, just as the capillary 304, extends beyond an upper end of the conduit 308 in this example. Additional seals 352 (represented by hollow circles) allow for gas tightness between the conduit 308 and the upper part of the electrospray probe. At the lower end, near tip 304* of the capillary, an inwardly angled flange-like portion of the hollow tube 350 may closely approach the outer circumference of the central capillary 304, or even contact it, however, is not rigidly attached to it. A possible gap between this closing portion of the hollow tube 350 and the outer circumference of the capillary 304 is preferably chosen as to maximize gas restriction. In such configuration without fixed attachment, the capillary 304 can be removed from the hollow tube 350, and from the spray probe in general, by simply pulling it out in an upward direction. Likewise, a/the capillary 304 can be (re-) inserted in the opposite downward direction. Removal and (re-)insertion may happen for example for maintenance purposes. Simple calculations indicate that the evacuated jacket 322 in conjunction with a stagnant gas layer 324 in a hollow tube 350 provides further improved thermal resistance.

In the embodiment of FIG. 3 the heater 320 surrounds the conduit 308, but a vacuum insulated jacket 322 together with a stagnant gas layer 324 can be used in designs where the heatable gas is heated prior to introduction into the conduit 308 by an external heater. Then, it should be ensured that the evacuated space reaches up to a point at the conduit 308 where the heatable gas is supplied to the conduit 308 so that heat transfer to the capillary 304 is impeded.

Figure 4:
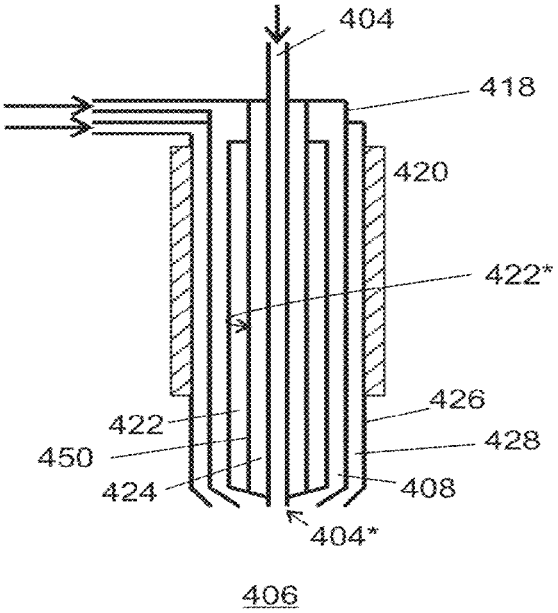
FIG. 4 is a cross-sectional diagram that illustrates third embodiment according to principles of the invention.

FIG. 4 is another example of an assembly for an electrospray ion source according to principles of the invention. It has a central capillary 404 that receives and transports a liquid, such as an effluent of an LC column, from one end to another end reaching into an ionization region 406. A first tube 418 is disposed at least partially around the central capillary 404 such that a first conduit 408 for guiding a first heatable gas, such as a nebulizer gas, is created proximate the central capillary 404. A second tube 426 is disposed at least partially around the first tube 418 such that a second conduit 428 for guiding a second heatable gas, such as a desolvation gas, is created proximate the first tube 418. In the example shown, a heater 420, such as a resistive heater, is located at an outer circumference of the second conduit 428 and is in thermal contact therewith. The second heatable gas can flow from a point where it is supplied to the second conduit 428 to an exit region of the second conduit 428 proximate the tip 404* of the capillary 404 while being heated. Heat from the second heated gas may be transmitted through an interface between the second conduit 428 and the first conduit 408 from the second heated gas to the first heatable gas. If such heat transfer is desired, the first tube 418 containing the first conduit 408 can be made of a heat conducting metal, for instance. If no such heat transfer is desired the first tube 418 can be made from a material of high heat resistance.

To prevent excessive heat transfer from the first heated gas to the liquid in the central capillary 404, a double-wall jacket 422 is disposed around the central capillary 404. The jacket 422 is evacuated internally as previously described and, by virtue of its position around the central capillary 404, impedes heat transfer from the first heatable gas, when heated, flowing proximate the central capillary 404 to the liquid in the central capillary 404. In this case, a further hollow tube 450 is disposed between the jacket 422 and the central capillary 404 and around the capillary 404. This hollow tube 450, just as described in conjunction with a previous embodiment, comprises a hollow space filled with a (annular) stagnant gas layer or stagnant air layer 424. In contrast to the embodiment described with reference to FIG. 3, the hollow tube 450 in this example does not reach beyond an upper limit of the first conduit 408 but ends there. Simple calculations indicate that the evacuated jacket 422 in conjunction with a stagnant air layer 424 in a hollow tube provides further improved thermal resistance.

The evacuated space within the jacket or sleeve 422, at an inner side 422*, may carry a coating for reflecting heat radiation, or may have an additional radiative heat shield (not illustrated) with low emissivity interposed between the two walls, as described before.

In the embodiment of FIG. 4 the heater 420 surrounds the second conduit 428, but a vacuum insulated jacket 422 together with a stagnant gas layer 424 can be used in designs where the second heatable gas is heated prior to introduction to the second conduit 428 by an external heater as described before.

Figure 5:
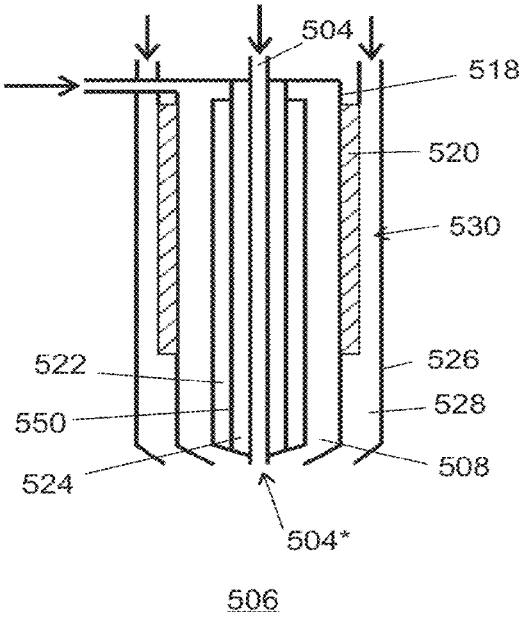
FIG. 5 is a cross-sectional diagram that illustrates a fourth embodiment according to principles of the invention.

FIG. 5 is another example of an assembly for an electrospray ion source according to principles of the invention. As before, it has a central capillary 504 that receives and transports liquid from one end to another end reaching into an ionization region 506. A first tube 518 with a tapering exit portion is disposed at least partially around the central capillary 504 such that a first (annular) conduit 508 for guiding a first heatable gas, such as a nebulizer gas, is created proximate the central capillary 504. A second tube 526 with a tapering exit portion is likewise disposed at least partially around the first tube 518 such that a second (annular) conduit 528 for guiding a second heatable gas, such as a desolvation gas, is created proximate the first tube 518. In the example shown a heater 520, such as a resistive heater, is located within parts of the second conduit 528 and leaves an annular space 530 between the heater 520 and the second tube 526 that extends parallel to a general axis of the assembly such that the second heatable gas can flow from a point where it is supplied to the second conduit 528 to an exit region of the second conduit 528 proximate the tip 504* of the capillary 504 in the example illustrated while being heated.

A double-wall jacket 522 is disposed around the central capillary 504. The jacket 522 is evacuated internally and, by virtue of its position at the outer circumference of the central capillary 504, impedes heat transfer from the first heatable gas, when heated, flowing proximate the central capillary 504 to the liquid in the central capillary 504. For increasing the overall heat resistance, as hereinbefore described, a hollow tube 550 containing a (annular) stagnant gas layer 524 is positioned between the evacuated jacket 522 and the central capillary 504 and around the capillary 504, and extends from a point near the exit end 504* of the capillary 504 up to a closing portion of the first tube 518 which also confines the first conduit 508.

In the embodiment of FIG. 5 the heater 520 surrounds the first conduit 508, and is located within, in some embodiments even integral with, the second conduit 528, but a vacuum insulated jacket 522, optionally with an additional stagnant gas layer 524, can be used in designs where at least one of the second heatable gas and the first heatable gas is heated prior to introduction to the second conduit 528 or the first conduit 508, respectively, by an external heater (not shown).

The wording "the heater surrounds the first conduit" implies an annular heater that thermally contacts the first tube over a whole circumference thereof. Such a design may be preferred to allow for homogeneous heating of the gas flowing in the conduit. However, it is also conceivable to provide for heat transmission to the gas only at selected sections of the tube wall.

With the design shown, the heater 520 may heat up not only the second gas in the second conduit 528 by direct contact, but also the first gas in the first conduit 508 by transmitting heat through an interface between the first conduit 508 and the second conduit 528. The interface may be the material layer, in other words the wall, of the first tube 518 in this case. For instance, it can be made from a heat conducting metal. It is, however, also possible to choose a material for the first tube 518, such as glass, ceramic or some kind of plastic, that restricts heat flow therethrough if the heat load on the first gas in the first conduit 508 shall be kept low.

Figure 6:
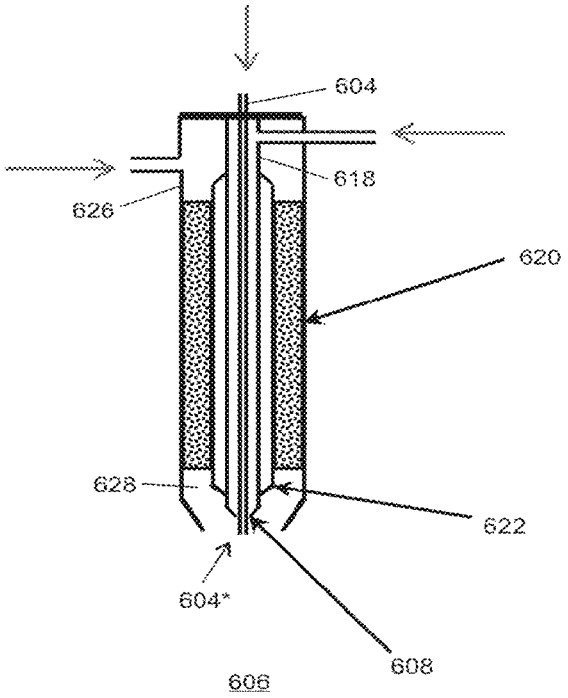
FIG. 6 is a cross-sectional diagram that illustrates a fifth embodiment according to principles of the invention.

FIG. 6 is yet a further example of an assembly for an electrospray ion source according to principles of the invention. It has a central capillary 604 that receives and transports a liquid from one end to another end reaching into an ionization region 606. A first tube 618 is disposed at least around parts of the central capillary 604 such that a first conduit 608 for guiding a first heatable gas, such as a nebulizer gas, is created proximate the central capillary 604. A second tube 626 is likewise disposed at least partially around the first tube 618 such that a second conduit 628 for guiding a second heatable gas, such as a desolvation gas, is created proximate the first tube 618. In the example shown a heater 620, such as a resistive heater, is located within parts of the second conduit 628 and may have longitudinal bores (not shown) that extend parallel to a general axis of the assembly such that the second heatable gas can flow from a point where it is supplied to the second conduit 628 to an exit region of the second conduit 628 proximate the tip 604* of the capillary 604 in the example illustrated while being heated. It goes without saying that the bores may also take a configuration different from a straight longitudinal one, such as a spiraling one, as long as fluid communication between the parts upstream of the heater 620 in the second conduit 628 and the parts downstream of the heater 620 in the second conduit 628 is provided.

A double-wall jacket 622 is disposed around and, in this example, directly contacting the first tube 618. The jacket 622 is evacuated internally and, by virtue of its position at the outer circumference of the first tube 618, impedes heat transfer from the second heatable gas, when heated, flowing proximate the first tube 618 to the first heatable gas flowing in the first conduit 608.

In the embodiment of FIG. 6, the heater 620 surrounds and is in thermal contact with the first conduit 608, and is integral with the second conduit 628, but a vacuum insulated jacket 622 can be used in designs where the first heatable gas is heated prior to introduction into the first conduit by an external heater (not illustrated). In such a configuration the double-wall jacket 622 should extend at least up to a point where the second already heated gas is introduced into the second conduit 628. A stagnant gas layer that yields additional thermal resistance, such as described in conjunction with some of the previous embodiments, is not strictly required here, but could also be provided easily upon slight changes to the instrumental set-up displayed.

Figure 7:
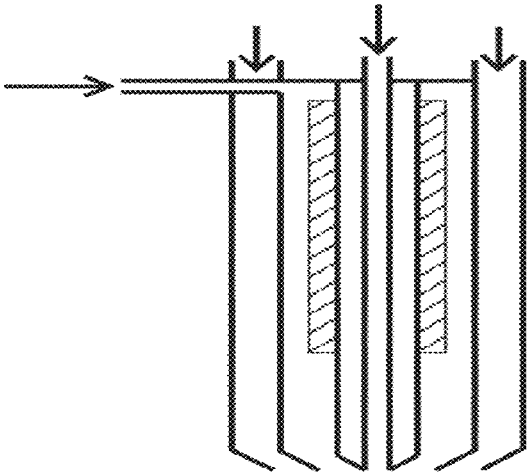
FIG. 7 is a cross-sectional diagram that illustrates a sixth embodiment according to principles of the invention.

FIG. 7 illustrates another example of an electrospray assembly with slightly different design. Without repeating any details which have been discussed extensively in conjunction with previous embodiments, it shows a design with (from a center in a radially outward direction) a capillary, an evacuated sleeve disposed about the capillary and covering large portions of the capillary along its longitudinal extension, a heater disposed about parts of the evacuated sleeve, a first tube largely encasing the first sub-assembly of capillary, sleeve and heater for providing a first conduit, as well as a second tube encasing the second sub-assembly of capillary, sleeve, heater and first tube for providing a second conduit. The heater transmits heat to the first gas which flows along in the first conduit, whereas the insulating sleeve prevents too much heat from being transmitted to the capillary.

Figure 8:
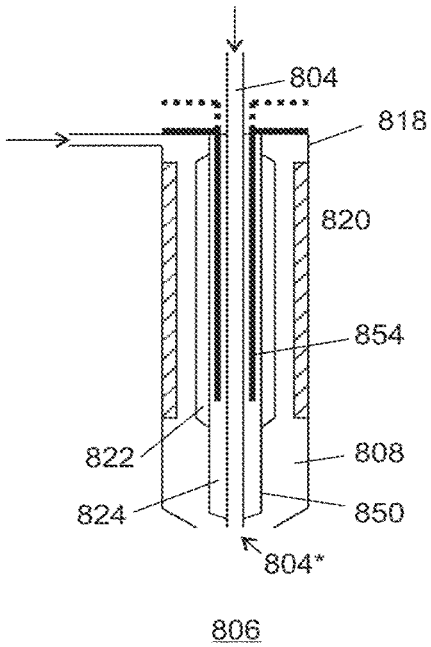
FIG. 8 is a cross-sectional diagram that illustrates a seventh embodiment according to principles of the invention.

FIG. 8 shows another embodiment of an assembly for an electrospray ion source according to principles of the invention. As before, a capillary 804 is provided for guiding a flow of liquid, which is to be electrosprayed into an ionization chamber 806. A tube 818 at least partially encases the capillary 804 such that a (annular) conduit 808 for guiding a heatable gas is created proximate the capillary 804. A thermal insulation 822 is located at an outer circumference of the capillary 804 such that heat transfer from the heatable gas flowing proximate the capillary 804 to the liquid in the capillary 804 is impeded.

The thermal insulation 822 may be comprised of an evacuated sleeve or jacket disposed about the capillary, just as described in previous embodiments. Additionally or alternatively, however, the thermal insulation may also be comprised of a stagnant air layer in a hollow tube, a circulating air flow and/or a solid layer of material with high heat resistance, such as fused silica or other types of glass or ceramics, or any combination thereof. The operator thus has high freedom of choice for the thermal insulation.

Further, a hollow tube 850 containing a stagnant gas 824 is interposed between the thermal insulation 822 and the outer circumference of the capillary 804, and surrounding the capillary 804, to further increase thermal resistance, as hereinbefore described in the context of other exemplary embodiments. A heat conductor 854 plays a vital role in the embodiment of FIG. 8. The heat conductor 854 reaches or extends with a first portion into an inner space of the hollow tube 850 in order to contact, or be immersed within, the stagnant gas 824 and receive heat therefrom. Moreover, the heat conductor 854 reaches or extends with a second portion upstream into a region where a substantially unheated gas is supplied to the conduit 808 so that the substantially unheated gas may contact the second portion of the heat conductor 854 directly or indirectly thereby receiving and carrying away heat which originates from the stagnant gas 824. In some embodiments the second portion of the heat conductor 854 may serve at least as part of the closing portion of the first tube 818 and the second conduit 808.

The heat conductor 854 in the embodiment shown generally has a tubular design with an outwardly extending flange-like structure at one end. The tube part which represents the first portion extends into the stagnant gas in the hollow tube 850 (here without contacting any boundaries) and receives heat therefrom which, over time, accumulates due to unavoidable insufficiencies of the thermal insulation 822 and poor heat transport of the low liquid flow in the capillary. The flange-like part which represents the second portion is at least in thermal contact with the upper closing portion of the tube 818 and conduit 808. With such configuration the still substantially unheated gas, upon entering the conduit 808, flows along the second portion or flange part of the heat conductor 854, receives heat therefrom and carries it away to a region further downstream where the actual heater 820, for example, a resistive heater, is located and heats the gas to the desired electrospray operating temperature. To increase the heat exchange effect, the flange part can have additional structural features such as further radiator-like protrusions which are indicated with dotted line in the figure. Furthermore, at least portions of the heat conductor 854 may have a structured surface as to increase heat transmission capabilities. However, it goes without saying that the exact shape and position of the heat conductor 854 are not limited to the example shown in FIG. 8. The conductor 854 does not have to be rotationally symmetric, for instance. It may also contact the capillary 804 or the radially more outwardly lying thermal insulation 822 if that is considered suitable.

The heat conductor 854 may generally be made from a material with low intrinsic heat resistance. Metals such as aluminum and copper, for instance, are particularly suited for this purpose.

The advantages of the embodiments include (non-exhaustively) (i) thin walls of the evacuated jacket allow compact design, (ii) metal or glass construction of the evacuated jacket allows high temperature operation at several hundred up to about 800 deg C, (iii) hermetically sealed jacket guarantees low background and chemical resistance, (iv) low thermal mass of the jacket allows for fast equilibrium times upon a change in temperature, and (v) potential incorporation into the containment structure of more than one gas, such as separating desolvation and nebulizer gases.

In many of the above described embodiments the exit portions of the first and second conduits have a tapered design. However, it goes without saying that the exit portions can also be straight as indicated in FIG. 1. Moreover, the capillary has been described as central. This is not to be interpreted as restrictive. It just means that the capillary is located in a central region of the spray probe. The capillary may be concentric or coaxial with the first tube and/or the second tube. Such configuration however is not mandatory, and other "asymmetric" designs are also conceivable.

Furthermore, cross sections of the conduits for the gases are depicted to be largely annular. But also in this case, an annular design is given by way of example only, and the considerations concerning the thermal balance are not tied to it. It is equally possible, for instance, to provide for partially filled-up annular conduits which contain isolated conduit channels for the flowing gases, probably with spiraling trajectories. Generally, there is no restriction on the shape of the conduits usable within the context of the present invention.

It will be understood that various aspects or details of the invention may be changed, or various aspects or details of different embodiments may be arbitrarily combined, if practicable, without departing from the scope of the invention. Furthermore, the foregoing description is for the purpose of illustration only, and not for the purpose of limiting the invention which is defined solely by the appended claims.

What is claimed is:

1. An assembly for an electrospray ion source, comprising:

a capillary for guiding a flow of liquid which is to be electrosprayed into an ionization chamber;

a first tube at least partially encasing the capillary such that a first conduit for guiding a first gas is created proximate the capillary; and a hollow member having an internal evacuated space and being located at an outer circumference of the capillary such that heat transfer from the first gas flowing proximate the capillary to the liquid in the capillary is impeded.

2. The assembly of claim 1, wherein the hollow member is an at least partially hollow jacket or sleeve disposed around the capillary, and the evacuated space is formed within the at least partially hollow jacket or sleeve.

3. The assembly of claim 1, wherein the hollow member is a double-layered wall of the capillary, and the evacuated space is formed within the double-layered wall.

4. The assembly of claim 1, further comprising a tubular structure containing a stagnant gas, the tubular structure being interposed between the hollow member and the outer circumference of the capillary.

5. The assembly of claim 4, further comprising a heat conductor reaching into an inner space of the tubular structure in order to contact the stagnant gas and receive heat therefrom, the heat conductor further extending upstream into a region where a substantially unheated first gas is supplied to the first conduit so that the substantially unheated first gas may contact a portion of the heat conductor directly or indirectly thereby receiving and carrying away heat which originates from the stagnant gas.

6. The assembly of claim 1, wherein the evacuated space is bordered by side walls of the hollow member, which side walls have one of a coating at an inner side for reflecting heat radiation and a radiative heat shield interposed therebetween.

7. The assembly of claim 1, wherein the first gas in the first conduit receives heat from a heat generator.

8. The assembly of claim 7, wherein the heat generator is thermally coupled to the first tube at an outer circumference thereof.

9. The assembly of claim 7, wherein the heat generator heats the first gas at a position outside the first conduit.

10. The assembly of claim 1, further comprising a second tube at least partially encasing the first tube such that a second conduit for guiding a second gas is created proximate the first tube.

11. The assembly of claim 10, wherein the second gas in the second conduit receives heat from a heat generator, and some heat is transmitted through an interface between the second conduit and the first conduit from the second heated gas to the first gas flowing through the first conduit.

12. The assembly of claim 10, wherein the first gas in the first conduit and the second gas in the second conduit simultaneously receive heat from a heat generator that is located at an interface between the first conduit and the second conduit, and is thermally coupled to the first conduit at an outer circumference thereof and to the second conduit at an inner circumference thereof.

13. The assembly of claim 1, wherein the capillary is removably disposed within one of the first tube, an evacuated sleeve, an evacuated jacket, and a tubular structure.

14. An assembly for an electrospray ion source, comprising:

a capillary for guiding a flow of liquid which is to be electrosprayed into an ionization chamber;

a first tube at least partially encasing the capillary such that a first conduit for guiding a first gas is created proximate the capillary;

a second tube at least partially encasing the first tube such that a second conduit for guiding a second gas is created proximate the first tube; and a hollow member having an internal evacuated space and being located at an interface between the first conduit and the second conduit such that heat transfer from the second gas flowing proximate the first tube to the first gas in the first tube is impeded.

15. The assembly of claim 14, wherein the second gas in the second conduit receives heat from a heat generator thermally coupled to the second tube at an outer circumference thereof.

16. The assembly of claim 14, wherein the second gas in the second conduit receives heat from a heat generator at a position outside the second conduit.

17. An assembly for an electrospray ion source, comprising:

a capillary for guiding a flow of liquid which is to be electrosprayed into an ionization chamber;

a tube at least partially encasing the capillary such that a conduit for guiding a heatable gas is created proximate the capillary;

a thermal insulation being located at an outer circumference of the capillary such that heat transfer from the heatable gas flowing proximate the capillary to the liquid in the capillary is impeded;

a tubular structure containing a stagnant gas, the tubular structure being interposed between the thermal insulation and the outer circumference of the capillary; and a heat conductor reaching into an inner space of the tubular structure in order to contact the stagnant gas and receive heat therefrom, wherein the heat conductor further extends upstream into a region where a substantially unheated gas is supplied to the conduit so that the substantially unheated gas may contact a portion of the heat conductor directly or indirectly thereby receiving and carrying away heat, which originates from the stagnant gas, upon entering the conduit.

18. The assembly of claim 17, wherein the thermal insulation comprises one of an at least partially evacuated hollow sleeve or jacket, a solid layer of material with high heat resistance, and a combination thereof.

19. The assembly of claim 17, wherein at least portions of the heat conductor have a structured surface to allow for high heat transmission.

20. An assembly for an electrospray ion source, comprising:

a capillary for guiding a flow of liquid which is to be electrosprayed into an ionization chamber;

a tube at least partially encasing the capillary such that a conduit for guiding a gas is created proximate the capillary;

a thermal insulation being located at an outer circumference of the capillary such that heat transfer from the gas flowing proximate the capillary to the liquid in the capillary is impeded; and a heat conductor thermally contacting at least one of the thermal insulation at a radially inward side and the capillary at a radially outward side in order to receive heat therefrom, wherein the heat conductor also thermally contacts a conduit portion in a region where a substantially unheated gas is supplied to the conduit so that the substantially unheated gas may receive and carry away heat, which originates from the thermal insulation or the capillary, upon entering the conduit.

* * * * *